US005828626A

United States Patent [19]

Castile et al.

[11] Patent Number: 5,828,626

[45] Date of Patent: Oct. 27, 1998

[54] ACOUSTIC OBJECT DETECTION SYSTEM AND METHOD

[75] Inventors: Brett Castile, Del Mar; Donald Owen, San Diego, both of Calif.

[73] Assignee: Otincon Corporation, San Diego, Calif.

[21] Appl. No.: 790,781

[22] Filed: Jan. 30, 1997

[51] Int. Cl.[6] ..... G08B 13/16

[52] U.S. Cl. ..... 367/93; 340/553

[58] Field of Search ..... 340/553; 367/93

[56] References Cited

U.S. PATENT DOCUMENTS

| | | | |
|---|---|---|---|
| 3,967,260 | 6/1976 | Massa | 367/94 |
| 3,986,182 | 10/1976 | Hackett | 340/525 |
| 4,106,003 | 8/1978 | Otani | 340/530 |
| 4,123,748 | 10/1978 | Otani | 367/93 |
| 4,134,110 | 1/1979 | Galvin | 340/552 |
| 4,288,867 | 9/1981 | Guthart | 367/93 |
| 4,319,349 | 3/1982 | Hackett | 367/94 |
| 4,360,905 | 11/1982 | Hackett | 367/94 |
| 4,499,564 | 2/1985 | Sirai | 367/93 |
| 4,512,000 | 4/1985 | Masuko | 367/93 |
| 4,516,229 | 5/1985 | Kearns | 567/95 |
| 4,606,015 | 8/1986 | Yamaguchi | 367/95 |
| 4,609,909 | 9/1986 | Miller et al. | 340/541 |
| 4,625,199 | 11/1986 | Pantus | 340/522 |
| 4,727,522 | 2/1988 | Steiner et al. | 367/94 |
| 4,729,120 | 3/1988 | Steiner et al. | 367/94 |
| 4,747,085 | 5/1988 | Dunegan et al. | 367/93 |
| 5,144,593 | 9/1992 | Forster et al. | 367/95 |
| 5,309,144 | 5/1994 | Lacombe et al. | 340/539 |

*Primary Examiner*—Glen Swann
*Attorney, Agent, or Firm*—Gray Cary Ware & Freidenrich

[57] ABSTRACT

A standing wave field is generated within a protected space, the standing wave field comprising a plurality of signals traveling along a plurality of propagation paths within the protected space, the propagation paths including reflections of the signals off of objects within the protected space. A change in a predetermined characteristic of the standing wave field is detected upon the changing of a physical characteristic of an object within said protected space, and an alarm signal is generated when said change in the standing wave field is greater than a predetermined threshold value.

29 Claims, 3 Drawing Sheets

ACOUSTIC OBJECT DETECTION SYSTEM AND METHOD

BACKGROUND OF THE INVENTION

This invention relates generally to a system and method for detecting an object in a protected space, and in particular to a system and method for using acoustic waves to detect an object in a protected space.

Acoustic systems for detecting an unauthorized intrusion into a building or a room are well known. Similar systems are well known for an underwater environment wherein underwater transducers are used to transmit and receive the acoustic energy. These conventional acoustic intrusion detection systems may be sonic Doppler motion sensors wherein a continuous acoustic signal is transmitted at constant amplitude and frequency into an enclosed space to be protected, such as a room. Some of the energy from the transmitted acoustic signal is scattered back by stationary objects, such as a chair, into one or more microphones that detect the scattered energy of the signals. If an object in the field of view of the acoustic transmitters or one of the microphones is in motion, a Doppler shift, as is well known, is imposed on the sound energy reflected off of the moving object, similar to a police's radar that determined the speed of a vehicle.

The sound energy detected by the microphones is a composite signal that includes the non-Doppler shifted energy scattered from stationary objects within the protected space and the Doppler shifted energy scattered from the moving object. Various known techniques may then be used to detect the Doppler shifted components within the detected signal. For example, the variation in the phase and/or amplitude of the composite signal may be detected. The detection of the phase and/or amplitude of the composite signal may be by known phase modulation or amplitude modulation detectors that may or may not be synchronous with the transmitted signal.

These conventional acoustic intrusion detection systems detect only motion within the protected space by measuring the Doppler shift of the acoustic energy caused by the moving object. These conventional systems also have reduced accuracy for objects that are not in the direct path of the sensors or microphones. In addition, these known detection systems cannot detect the presence of a stationary new object within the protected space because the stationary new object does not generate a detectable Doppler shifted signal.

Thus, there is a need for an acoustic object detection system and method which avoid these and other problems of known devices, and it is to this end that the present invention is directed.

SUMMARY OF THE INVENTION

The invention provides an acoustic detection system and method wherein the motion of an object may be detected. In addition, the presence of an object or the absence of an object within a protected space may be detected. These objects may be detected in a protected space that may be enclosed or partially enclosed. The protected space may be underwater space or air space. The system may also reject transient false alarms, and update itself automatically as the conditions of the protected space change.

In accordance with the invention, a system and method for detecting an object within a protected space is disclosed wherein a standing wave field is generated within a protected space, the standing wave field comprising a plurality of signals traveling along a plurality of propagation paths within the protected space, the propagation paths including reflections of the signals off of objects within the protected space, a change in a predetermined characteristic of the standing wave field is detected upon the changing of a physical characteristic of an object within said protected space, and an alarm signal is generated when said change in the standing wave field is greater than a predetermined threshold value.

DETAILED DESCRIPTION OF A PREFERRED EMBODIMENT

The invention is particularly applicable to a system and method for acoustically detecting an object within a protected space. It is in this context that the invention will be described. It will be appreciated, however, that the system and method in accordance with the invention has greater utility.

Figure 1:
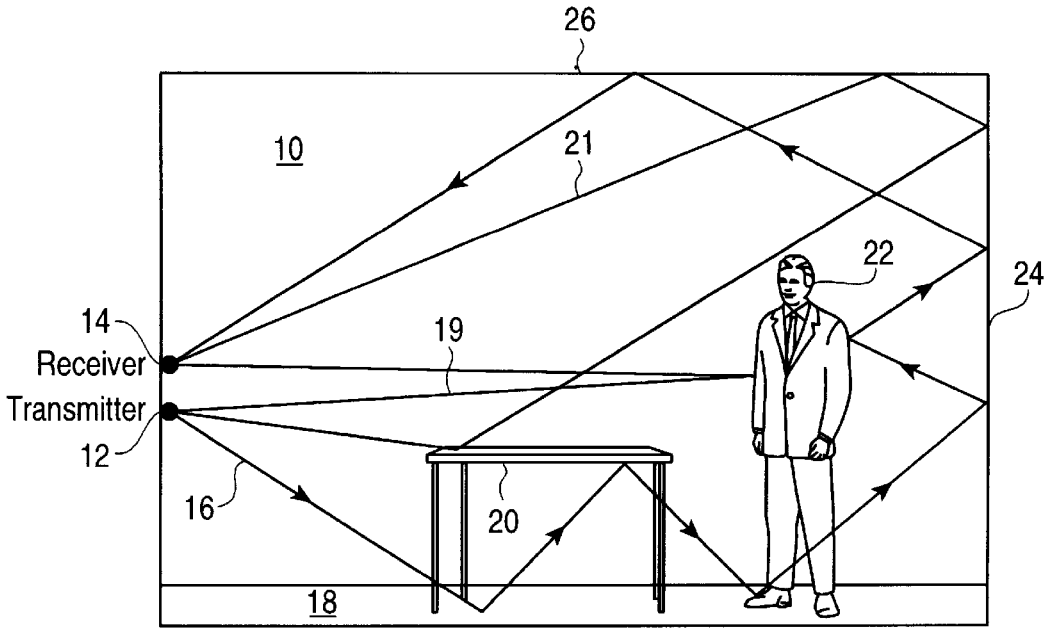
FIG. 1 is a diagram illustrating an acoustic detection system in accordance with the invention located within an air space, such as a room.

FIG. 1 is a diagram of an acoustic detection system in accordance with the invention operating within an enclosed air space 10, such as a room. As shown, one or more acoustic signals may be generated by one or more electro-acoustical transmitters 12 (only one being illustrated) and may be detected by one or more receivers 14 (only one being illustrated) which includes a sensor, such as a microphone, in an air space. For example, a first acoustic signal 16 may reflect off of a floor 18 of the room, a table 20, twice off of a human 22 within the room, twice off of a back wall 24 of the room, and off of a ceiling 26 of the room before being detected by the electro-acoustic microphone. Similarly, a second acoustic signal 19 and a third acoustic signal 21 may also reflect off of boundaries of the room and objects within the room. The details of the acoustic signal will be described below in more detail. As shown, the transmitter may generate a plurality of acoustic signals that may reflect off of various objects within the protected space and may eventually be detected by the microphone. The invention is not limited to any particular position of the transmitters and/or the detectors, and may include one or more transmitters and one or more detectors. The acoustic signals will now be described in more detail.

The one or more transmitters 12 may generate and transmit a continuous sinusoidal acoustic signal of constant amplitude and frequency into the space to be protected. As described below, the acoustic signals may also be generated and transmitted into a partially enclosed air space as well as an underwater space. The energy of the acoustic signal may be transmitted into every part of the protected space, and the acoustic signals may be generated by direct path propagation of an acoustic signal from one or more electro-acoustic transducers. The generated acoustic signals scatter and/or reflect off of boundaries of the protected space as well as objects within the protected space. These combined acoustic signals form a complex standing wave field within the protected space. If anything disturbs this wave pattern, such as a person or object leaving, entering or moving within the protected space, the scattered acoustic signals contributing to the standing wave will change. If the standing wave field is changed anywhere within the protected space, then it is also changed, to some degree, everywhere within the protected space and the change may be detected.

The standing wave acoustic field may be detected by one or more detectors 14 within the protected space. A change in the phase and/or amplitude of the standing wave field detected by the detector 14 indicates that there has been a change in the standing acoustic wave field somewhere within the protected space. Because a change anywhere in the protected space may be detected, the detection system in accordance with the invention is not limited to objects in the direct line of sight of the transmitters or detectors. The sensitivity, however, is less for objects out of the direct line of sight of the transmitters or detectors. The change in the acoustic standing wave field indicates a change in the position of one or more scatterers (i.e., objects and boundaries) within the protected space. The change in the position of the scatterers indicates either that someone or something has intruded into the protected space, or that someone or something has moved, been added or been removed from the protected space. Thus, the acoustic detection system in accordance with the invention may detect 1) movement of an object within the protected space; 2) the presence of an object that was nor previously within the protected space; and/or 3) the absence of an object that was previously within the protected space.

To better understand the generated standing acoustic wave field in accordance with the invention, the acoustic signals received by the detectors 14 may be thought of as a sum of multiple sinusoids, wherein each sinusoid represents a propagation path between the acoustic transmitter 12 and the detector 14, which may include multiple reflections and scatters off of various objects or boundaries within the protected space. The standing field acoustic signal, s(t), received by the detector may be represented by the following equation:

$$s(t) = \sum_j A_j \sin(\omega t + \theta_j) \tag{1}$$

where j is an index counting each of the acoustic signals traveling along propagation paths from the transmitter to the receiver, $A_j$ is the amplitude of the signal component transmitted over the jth propagation path, and $\theta_j$ is the phase of the signal component transmitted over the jth propagation path. If any of the phases or amplitudes of any of these propagation path signals are changed, or if any propagation path is added or removed, the amplitude and/or phase of the composite signal, s(t), is changed. Depending on the stability of the protected space, the acoustic frequency used, and the size of the change, the amplitude and/or phase change in s(t) may be measured after some event has occurred within the protected space. The change in amplitude or phase may be determined by comparing a previously measured phase and/or amplitude value with a current phase and/or amplitude value. The previously measured values are updated occasionally, but are only updated if no detections are made within a specified time interval which permits the detection of the addition or removal of an object even if the object ceases any motion, as described below in more detail.

The detection of the presence or absence of a stationary object in a protected space by changes in the standing wave field, as opposed to only the detection of the motion of the object by Doppler shifts, in accordance with the invention provides several advantages. First, it permits detection of a very slowly moving object. A very slowly moving object may have a Doppler shift signal frequency that is below the bandpass filter frequency of a conventional motion detector so that a conventional motion detector will not detect the presence of the slowly moving object. Second, it permits the detection of an object that moves rapidly into the protected space and then stops quickly. The time period of the change in the Doppler shift for this object is short because of the rapid speed of the object so that a conventional motion detector may not treat the rapid movement as an intrusion because the time period of the shift is too short. In addition, since the object then stops within the protected space, the motion detector may not detect the object, whereas the detection system in accordance with the invention will detect the additional presence of the object within the protected space. Third, the detection system in accordance with the invention may have a system for reducing false alarms because if an outside source or a transient event within the protected space, not involving an intrusion, creates a transient signal and that signal may be detected as an alarm by a conventional motion detector using Doppler techniques. However, for the detection system in accordance with the invention, if the transient signal has ceased and the standing wave within the protected space was unchanged by the transient signal, then the transient signal may be treated as a false alarm, as described below in more detail. If the transient signal event occurs and the signal is changed as a result of the transient event indicating the presence on a new object within the protected space, then the presence of the new object may be detected. Now, a detection system in accordance with the invention is a partially enclosed underwater environment will be described.

Figure 2:
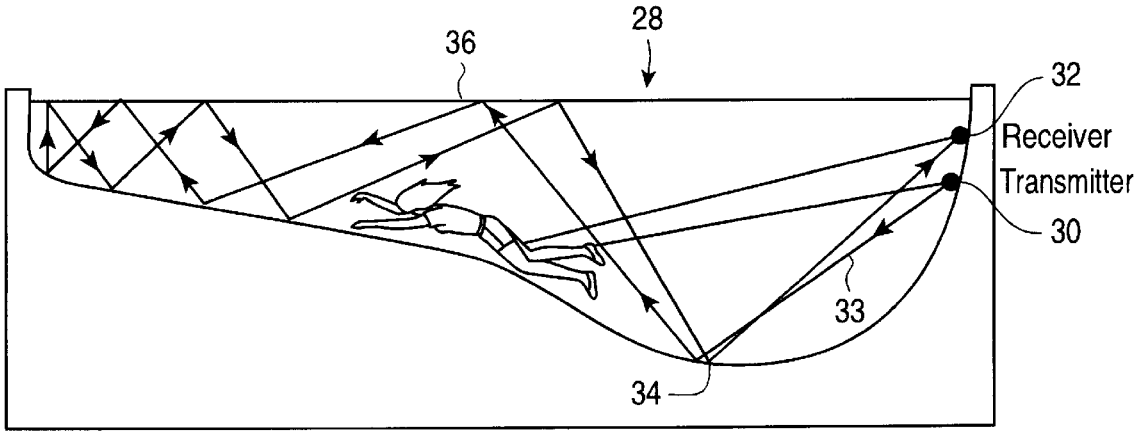
FIG. 2 is a diagram illustrating an acoustic detection system in accordance with the invention located within a partially enclosed water space, such as a swimming pool.

FIG. 2 is a diagram of a detection system in accordance with the invention being used within a partially enclosed underwater protected space 28, such as a swimming pool. As shown, the detection system may be used to detect the presence of an object within a swimming pool, such as when a person has fallen into the pool. The detection system may include one or more transmitters 30 (only one being illustrated), that may be specially designed underwater acoustic projector, or hydrophones for use in a water environment used as transmitters, and one or more detectors 32 (only one being illustrated) that may also be hydrophones. The one or more transmitters may generate one or more acoustic signals that may be transmitted throughout the protected space, as described above, to generate a standing wave field within the protected space. For example, a first acoustic signal 33 may reflect a number of times off of a bottom 34 of the protected space and a number of times off of a top surface 36 of the water. The reflected signal may then be detected by the detector 32. The generation of the standing wave field was described above, and will not be described here in detail. In the water environment, the surface of the water may act as a boundary of the partially enclosed space. At the interface between the water and the air, the refractive index of the water and the air are sufficiently different that any acoustic energy that strikes the interface typically reflects back off of the interface so that the interface may act as a boundary for purposes of the invention. Now, an example of an electrical circuit that may be connected to the detectors of FIG. 1 and 2 to detect an object within a protected space that may be a water environment or an air environment will be described.

Figure 3:
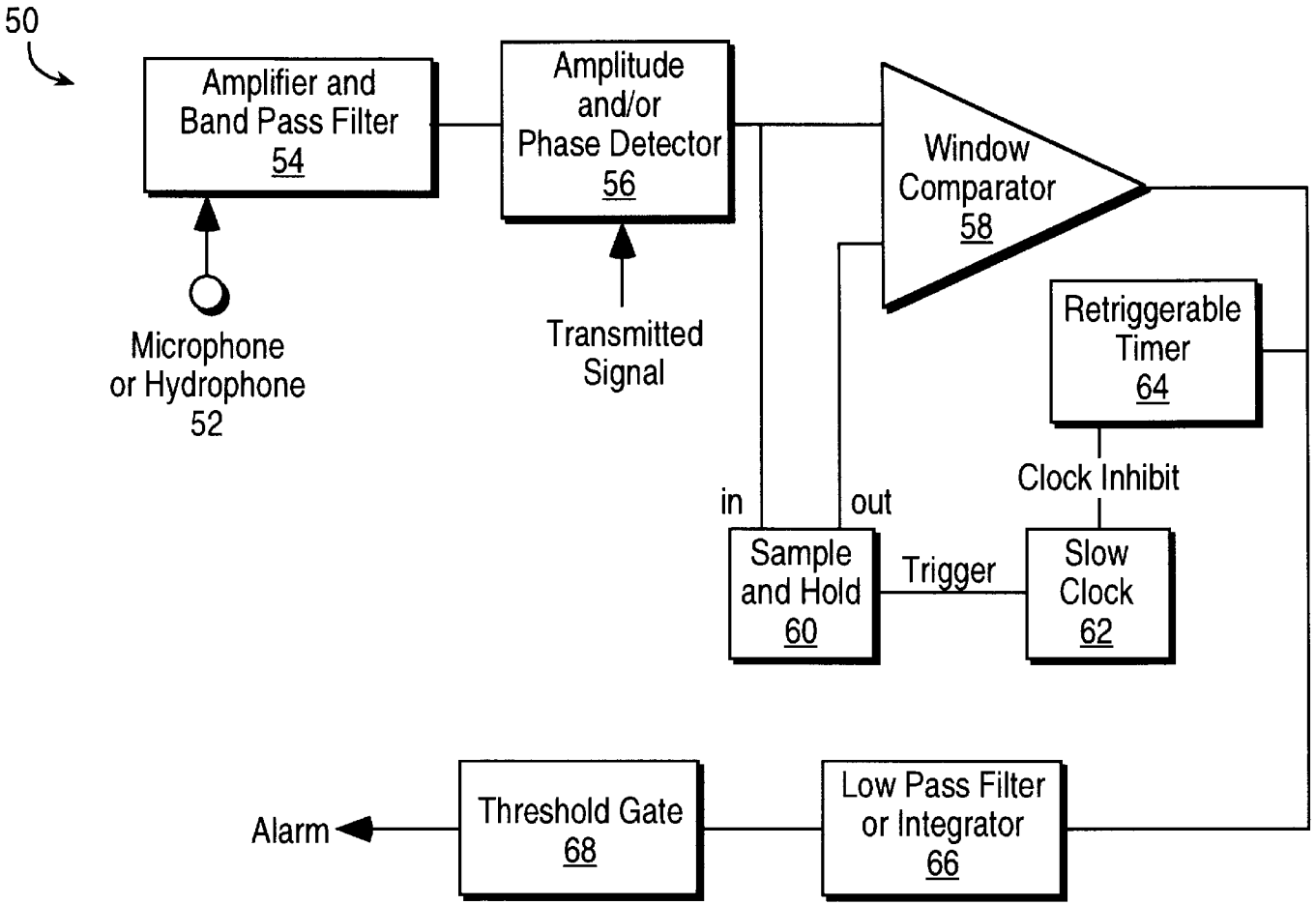
FIG. 3 is a block diagram of an electrical circuit which may be used in an acoustic detection system in accordance with the invention for receiving and detecting acoustic energy.

FIG. 3 is a block diagram of an example of an electrical circuit 50 that may be used to detect an object within a protected space or the motion of the object, in accordance with the invention. The electrical circuitry may be implemented either with analog components or digital components. The electrical circuit receives the standing wave field signal detected by a sensor 52 and the output of the sensor may be passed to an amplifier/band pass filter 54 which suppresses signal energy at frequencies that are outside of a band that would be normally expected due to Doppler shifts from intruders or objects moving at reasonable speeds. The output of the amplifier/band pass filter may be passed to a detector 56 that may detect a predetermined characteristic of the received signal, such as the phase and/or the amplitude of the received signal. The detection system in accordance with the invention may work by detecting either of the predetermined characteristics of the received signal. The detector 56 may measure the phase and/or amplitude of the received signal with the phase being relative to that of the originally transmitted signal.

The output of the detector 56 may be fed into a window comparator 58 which compares the currently detected characteristics value, e.g., amplitude and/or phase value of the received signal with the characteristics of a prior signal and determines whether or not the currently detected characteristics of the received signal is significantly different than the characteristics of a prior signal. A sample and hold circuit 60 may store the values of the amplitude and/or phase of the signal at some prior time. The sample and hold circuit 60 may be occasionally triggered to store new values of the amplitude and/or phase values so that the system may update itself for variations within the protected space, such as a change in temperature. These variations within the protected space are not sufficient to cause an alarm, but the system should be updated to account for these changes. The rate that the prior values are updated depends on the characteristics of the protected space and how rapidly the physical characteristics of the protected space change. For a protected space that is temperature and humidity controlled, the physical characteristics of the protected space change very slowly, if at all, so the update rate may be very slow. The rate of the updates may be controlled by a clock 62, and the rate of the clock may be determined according to the characteristics of the protected space. For example, for a swimming pool with a fairly constant temperature, the clock rate may be every fifteen minutes. The clock rate may be manually set for each different protected space, but may also be automatically set by the system. For example, the system may determine the change in temperature of the protected space over a predetermined time and then set the clock rate based on the change of the temperature. The rate of the clock determines how long the system waits before it updates the stored values.

The system may also have circuitry for preventing new updates of the stored amplitude and/or phase values for a predetermined time after a transient event has occurred. The system may also have circuitry for preventing an update of the stored amplitude and/or phase values for a predetermined time if a consistent difference in the received acoustic signal is detected which would indicate that an object has been moved, added or removed from the protected space. To prevent the updating of the values during or shortly after a transient event, the output of the comparator 58 may be passed to a retriggerable timer 64 that may inhibit the clock 62 from generating a trigger signal that causes the values to be updated. For any event detected by the comparator, the retriggerable timer is triggered which causes the stored values to be held for a predetermined amount of time. At the same time, any output of the comparator may also cause an alarm condition. The retriggerable timer immediately inhibits the dock upon a change in the output of the comparator and continues to prevent an update from occurring for a predetermined amount of time. The retriggerable timer may be continually retriggered for as long as the output of the window comparator 58 indicates either the continuation of transient events or a condition in which the acoustic signals within the protected space remain changed from a previous condition. The retriggering of the timer prevents an update of the stored values from occurring until the transient event or the constant condition is over which permits the detection system to detect the change in the received signal before updating the stored value.

The output of the window comparator 58 may be passed to a low pass filter/integrator 66 and a threshold gate 68 that may delay the triggering of an alarm until a transient event of relatively long duration is detected, or until there is a short transient event followed by a change in the acoustic standing wave field within the protected space. The output of the comparator 58 is binary (i.e, a "1" or a "0") so that the amplitude of the output of the comparator is limited. Therefore a high energy, loud transient acoustic signal or a low energy, soft transient acoustic signal will both appear to be identical to the low pass filter. When the output of the low pass filter reaches the level of the threshold gate within a certain predetermined period of time, an alarm signal is generated. Now, the operation of the detection system in accordance with the invention will be described.

Figure 4:
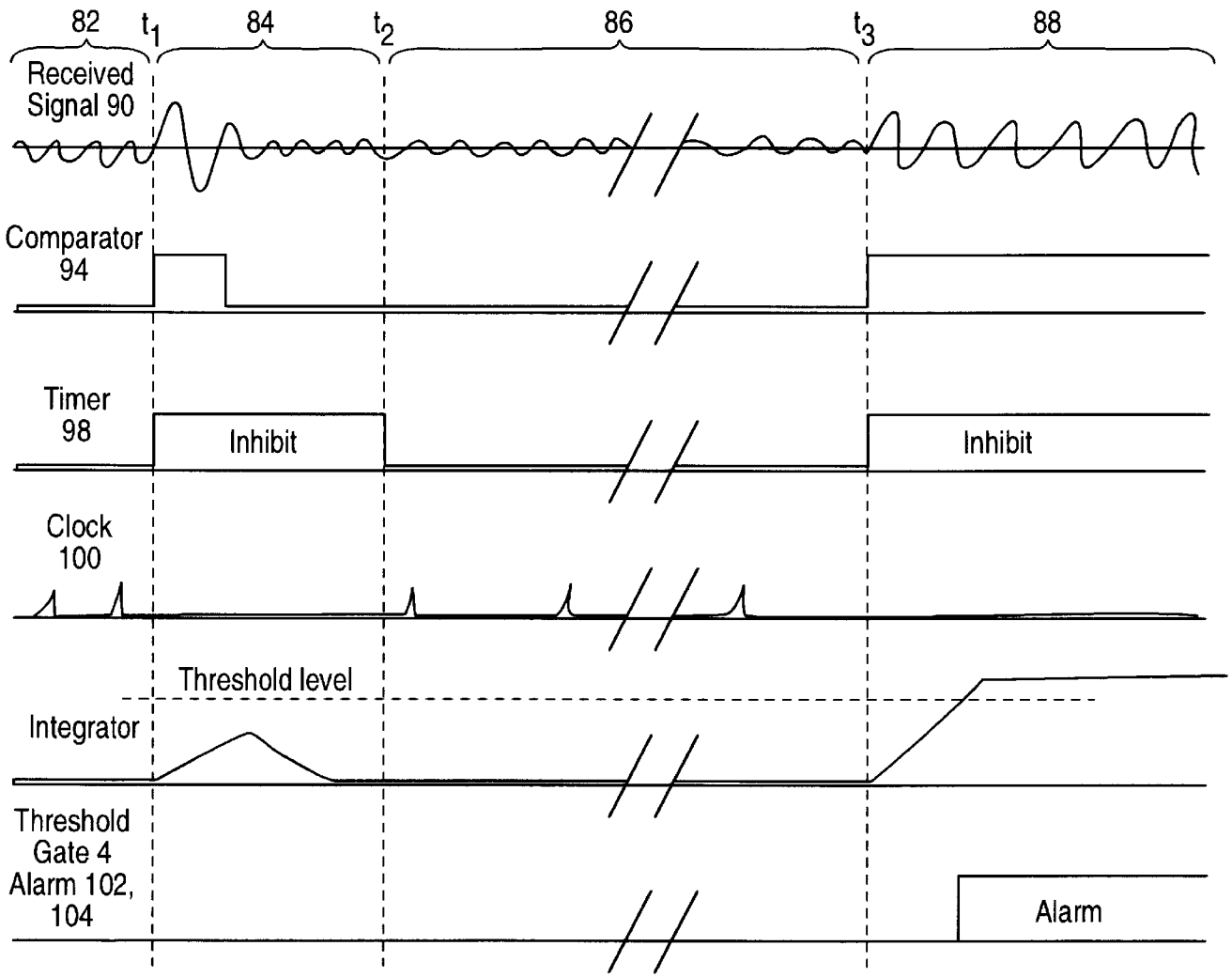
FIG. 4 is a timing diagram showing the output of the electrical circuitry of FIG. 3 in response to various events.

FIG. 4 is a plurality of timing diagrams showing the output of the electrical circuit of FIG. 3 for several different events within the protected space. During a first time period 82 from 0 to $t_1$, no event occurs within the protected space. During a second time period 84 from $t_1$ to $t_2$, a short transient event occurs within the protected space. During a third time period 86 from $t_2$ to $t_3$, no event occurs within the protected space, and during a fourth time period 88 from $t_3$ to $t_4$, an object is removed from the protected space. The receiver signal is now changed in phase and/or amplitude.

The plurality of timing diagrams show a received signal 90, an output 94 of the window comparator 58 an output 98 of the timer 64, an output 100 of the clock 62, an output 102 of the threshold gate 68, and an alarm signal 104. As shown, the amplitude of the received signal increases during the second and fourth time periods 84, 88. However, the event that occurs during the second time period is shorter than the event that occurs during the fourth time period. The increased amplitude of the received signal causes the output of the comparator to go high during the second and fourth time periods. The output of the sample and hold, which is the stored value of a prior received signal, does not change during the time the output of the window comparator is high, nor for a predetermined time thereafter, because the timer and clock inhibit the updating of the stored value. As shown, the timer and clock inhibit the update either during or shortly after the short transient signal or during the longer event. The transient event will never cause an update of the stored value. The stored value will be updated after a longer event has occurred if the input signal returns nearly enough to its previous phase and amplitude to be within the window of the comparator, or, if the entire system is reset to its new environment.

The output of the threshold gate is low during the second time period because the length of the transient event is too short and is filtered out by the threshold gate. The output of the threshold gate for the longer event during the fourth time period, however, goes high because the longer event has a sufficient time period to pass through the threshold gate, and an alarm signal is generated. The longer event during the fourth time period may be either an object moving within the protected space, an object having been removed from the protected space, or an object being inserted into the protected space. Thus, the system in accordance with the invention may detect an object within the protected space, but also reject false alarms.

While the foregoing has been with reference to a particular embodiment of the invention, it will be appreciated by those skilled in the art that changes in this embodiment may be made without departing from the principles and spirit of the invention, the scope of which is defined by the appended claims.

We claim:

1. A system for detecting an object within a protected space, comprising:

means for generating a standing wave field within a protected space, the standing wave field comprising a plurality of signals traveling along a plurality of propagation paths within the protected space, the propagation paths including reflections of the signals off of objects within the protected space;

means for detecting a change in a predetermined characteristic of the standing wave field upon the changing of a physical characteristic of an object within said protected space, the physical characteristic being the presence or absence of the object in the protected space; and means for generating an alarm signal when said change in the standing wave field is greater than a predetermined threshold value to detect the presence or absence of the object in the protected space.

2. The system of claim 1, wherein said physical characteristic of the object further comprises the movement of the object within the protected space.

3. The system of claim 2, wherein said change detecting means comprises means for detecting a change in amplitude of the standing wave field.

4. The system of claim 3, wherein said change detecting means further comprises means for detecting a change in phase of the standing wave field.

5. The system of claim 4, wherein said detecting means further comprises means for comparing one of the phase or the amplitude of the standing field wave to a stored value of one of the phase or the amplitude to determine a change in the standing wave field.

6. The system of claim 5, wherein said comparison means comprises means for storing a value of the predetermined characteristic at a prior time, means for generating an update signal, and means for updating said stored value based on said update signal.

7. The system of claim 6, wherein said means for generating the update signal comprises means for automatically determining the time period of the update signal for a particular protected space.

8. The system of claim 6, wherein the protected space comprises one of an enclosed air space or a partially enclosed air space.

9. The system of claim 6, wherein said protected space comprises one of a partially enclosed underwater space or an enclosed underwater space.

10. The system of claim 2, wherein said change detecting means comprises means for detecting a change in phase of the standing wave field.

11. A system for detecting an object within a protected space, comprising:

means for sampling an acoustic standing wave field generated within a protected space, the standing wave field comprising a plurality of signals traveling along a plurality of propagation paths within the protected space, the propagation paths including reflections of the signals off of objects within the protected space;

means for detecting a change in a predetermined characteristic of the standing wave field when a physical characteristic of an object changes within said protected space, the physical characteristic being the presence or absence of the object in the protected space; and means for generating an alarm signal when said change in the standing wave field is greater than a predetermined threshold value to detect the presence or absence of the object in the protected space.

12. The system of claim 11, wherein said physical characteristic of the object further comprises the movement of the object within the protected space.

13. The system of claim 12, wherein said detecting means comprises means for detecting a change in amplitude of the standing wave field.

14. The system of claim 13, wherein said change detecting means further comprises means for detecting a change in phase of the standing wave field.

15. The system of claim 14, wherein said detecting means further comprises means for comparing one of the amplitude or the phase of the standing field wave to a stored value of the one of the amplitude or phase to determine a change in the standing wave field.

16. The system of claim 15, wherein said comparison means comprises means for storing a value of the predetermined characteristic at a prior time, means for generating an update signal, and means for updating said stored value based on said update signal.

17. The system of claim 16, wherein the protected space comprises one of an enclosed air space or partially enclosed air space.

18. The system of claim 16, wherein said protected space comprises one of a partially enclosed underwater space or an enclosed underwater space.

19. The system of claim 12, wherein said detecting means comprises means for detecting a change in phase of the standing wave field.

20. A method for detecting an object within a protected space, comprising:

sampling a standing wave field generated within a protected space, the standing wave field comprising a plurality of signals traveling along a plurality of propagation paths within the protected space, the propagation paths including reflections of the signals from objects within the protected space;

detecting a change in a predetermined characteristic of the standing wave field when an physical characteristic of the object changes within said protected space, the physical characteristic being the presence or absence of the object in the protected space; and generating an alarm signal when said change in the standing wave field is greater than a predetermined threshold value to detect the presence or absence of the object in the protected space.

21. The method of claim 20, wherein said physical characteristic of said object further comprises movement of the object within the protected space.

22. The method of claim 21, wherein said detecting further comprises detecting a change in amplitude of the standing wave field.

23. The method of claim 22, wherein said change detecting further comprises detecting a change in phase of the standing wave field.

24. The method of claim 23, wherein said detecting further comprises comparing one of the amplitude or the phase of the standing field wave to a stored value of one of the amplitude or the phase to determine a change in the standing wave field.

25. The method of claim 24, wherein said comparison comprises storing a value of the predetermined characteristic at a prior time, and updating said stored value periodically to track variations within the protected space.

26. The method of claim 25, wherein the protected space comprises one of an enclosed air space or a partially enclose air space.

27. The method of claim 25, wherein said protected space comprises one of a partially enclosed underwater space or an enclosed underwater space.

28. The method of claim 21, wherein detecting further comprises detecting a change in phase of the standing wave field.

29. A system for detecting an object within a protected space, comprising:

a transmitter that transmits an acoustic signal into a protected space;

a detector that detects an acoustic standing wave field with the protected space, the standing wave field comprising a plurality of signals reflected from objects within said protected space;

a detector which measures the value of a predetermined characteristic of said standing wave field when a physical characteristic of an object changes within said protected space, the physical characteristic being the presence or absence of the object in the protected space;

a comparator that generates a comparison value from said predetermined characteristic value and a stored predetermined characteristic value; and an alarm signal generator that generates an alarm signal when said comparison value is greater than a predetermined threshold value to detect the presence or absence of the object in the protected space.

* * * * *

UNITED STATES PATENT AND TRADEMARK OFFICE

CERTIFICATE OF CORRECTION

PATENT NO. : 5,828,626
DATED : October 27, 1998
INVENTOR(S) : Castile et al

It is certified that error appears in the above-identified patent and that said Letters Patent is hereby corrected as shown below:

On the title page:

[73] Assignee: Orincon Corporation, San Diego, Calif.

Signed and Sealed this

First Day of June, 1999

*Attest:*

Q. TODD DICKINSON

*Attesting Officer*

*Acting Commissioner of Patents and Trademarks*